US008087175B2

(12) United States Patent
Kluge et al.

(10) Patent No.: US 8,087,175 B2
(45) Date of Patent: Jan. 3, 2012

(54) SHAVING FOIL FOR AN ELECTRIC SHAVING APPARATUS

(75) Inventors: Martin Kluge, Flörsheim am Main (DE); Andreas Wurl, Kronberg (DE); Silvia Stange, Diez (DE); Pedro Stange, Diez (DE); Andreas Peter, Kronberg (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/437,156

(22) Filed: May 7, 2009

(65) Prior Publication Data

US 2009/0271994 A1 Nov. 5, 2009

Related U.S. Application Data

(63) Continuation of application No. PCT/EP2007/009070, filed on Oct. 19, 2007.

(30) Foreign Application Priority Data

Nov. 8, 2006 (DE) ..... 10 2006 052 622

(51) Int. Cl.
*B26B 19/04* (2006.01)

(52) U.S. Cl. ..... 30/346.51; 30/43.9; 30/43.92

(58) Field of Classification Search ..... 30/43.6, 30/43.9, 43.92, 346.51
See application file for complete search history.

(56) References Cited

U.S. PATENT DOCUMENTS

| | | | | | |
|---|---|---|---|---|---|
| 2,198,833 | A * | 4/1940 | Muros | 30/43.9 |
| 2,234,929 | A * | 3/1941 | Lynch | 30/43.9 |
| 2,345,263 | A * | 3/1944 | Jepson | 30/43.9 |
| 2,616,170 | A * | 11/1952 | Keblusek | 30/43.2 |
| 3,916,522 | A * | 11/1975 | Sakai et al. | 30/346.51 |
| 4,493,149 | A * | 1/1985 | Tanahashi et al. | 30/43.92 |
| 5,901,446 | A * | 5/1999 | Szymansky | 30/43.92 |
| 7,065,879 | B2 * | 6/2006 | Bader et al. | 30/43.92 |
| 7,845,079 | B2 * | 12/2010 | McGuire | 30/43.92 |
| 2009/0271994 | A1 * | 11/2009 | Kluge et al. | 30/346.51 |

FOREIGN PATENT DOCUMENTS

| | | |
|---|---|---|
| CH | 424 528 | 11/1966 |
| CH | 453 128 | 5/1968 |
| DE | 1 752 740 | 9/1957 |
| DE | 1 797 581 | 10/1959 |
| DE | 23 21 028 | 11/1974 |
| DE | 24 55 723 | 1/1983 |
| DE | 101 39 209 | 3/2003 |
| EP | 1 481 775 | 5/2004 |
| GB | 524471 | 8/1940 |
| GB | 954646 | 8/1959 |

* cited by examiner

*Primary Examiner* — Hwei C Payer
(74) *Attorney, Agent, or Firm* — Kelly L McDow; Jay A Krebs

(57) ABSTRACT

A shaving foil for an electric shaving apparatus. The shaving foil includes a perforated region with a plurality of holes which are separated from each other by bars. The perforated region is divided at least into two zones, preferably a central zone, a first edge zone, and a second edge zone. The central zone is arranged between the first edge zone and the second edge zone. The holes in the central zone have (i) an average size which is smaller than the average size of the holes in the first edge zone and in the second edge zone, (ii) a floating mean value of the size of the openings in the central zone smaller than a floating mean value of the size of the openings in the first edge zone and the second edge zone, or both (i) and (ii).

1 Claim, 8 Drawing Sheets

SHAVING FOIL FOR AN ELECTRIC SHAVING APPARATUS

CROSS-REFERENCE TO RELATED APPLICATIONS

This application is a continuation of, and claims priority under 35 U.S.C. 120 from, International Application No. PCT/EP2007/009070, filed Oct. 19, 2007, which claims priority to German Application No. 10 2006 052 622.8, filed Nov. 8, 2006. The contents of each of these applications are incorporated herein by reference in their entirety.

TECHNICAL FIELD

This invention relates to a shaving foil for an electric shaving apparatus. In addition, the present invention relates to an electric shaving apparatus having such a shaving foil and to a method of manufacturing a shaving foil.

BACKGROUND

Some electric shaving apparatuses have at least one perforated shaving foil and at least one undercutter which is constructed to be movable relative to the shaving foil. The shaving foil has a plurality of holes into which hairs thread themselves during the shaving operation. The undercutter is arranged in direct proximity to the shaving foil and is continually moved past the holes of the shaving foil during the shaving operation. As a result, the hairs which thread themselves into the holes of the shaving foil are severed by the undercutter. In this process, the configuration of the shaving foil, in particular the size and shape of the holes, influences the shaving result achievable with the shaving apparatus.

DE 24 55 723 C2 describes an average diameter of the holes in a peripheral region of the shaving foil, which serves at least partly to mount the shaving foil on a shaving head frame, as smaller than an average diameter of the holes in a central region of the shaving foil. In this arrangement, the relationship of the cross-sectional area of the hollow bars separating the holes from each other, which area is measured across the thickness of the shaving foil, to the holes over the complete shaving foil is coordinated in order to achieve a nearly constant flexural resistance. In this way it is intended to design the shaving foil such that it displays a nearly constant flexural resistance over all the perforated regions while retaining stable edge regions and a thin central region.

DE 23 21 028 A describes a screen foil with screen holes of different dimensions, which is adjustably arranged in the shaving head of a dry shaving apparatus. The screen foil has a single undivided perforated zone in which the dimensions of the screen holes change continually in the adjusting direction of the screen foil. This is intended to enable optimum adaptation of the screen foil to the different conditions of facial skin on the user or various users.

SUMMARY

In one aspect, a shaving foil for an electric shaving apparatus includes a perforated region with a plurality of holes which are separated from each other by bars. The perforated region is divided at least into a central zone, a first edge zone and a second edge zone, with the central zone being arranged between the first edge zone and the second edge zone. The shaving foil is characterized in that the holes in the central zone have an average size which is smaller than the average size of the holes in the first edge zone and in the second edge zone and/or in that a floating mean value for the size of the holes in the central zone is smaller than that in the first edge zone and in the second edge zone.

The shaving foil has the advantage of enabling a shave which is very thorough and at the same time gentle on the skin. This is achieved through variation of the hole size in the individual zones of the perforated region of the shaving foil, as a result of which favorable conditions regarding the arching of skin into the holes of the shaving foil are created during a shave throughout the contact area between the shaving foil and the skin of the user of the shaving apparatus.

The zones of the shaving foil do not have to exist as clearly assigned or sharply delimited regions; it suffices if there is a corresponding variation of the average perforation hole size along at least one direction. The corresponding zones are formed by the variation itself. The variation of the hole sizes takes place preferably continuously because—as will be explained later—this results in favorable mechanical properties, for example optimum adaptation of the shaving foil to the associated undercutter(s).

The central zone is arranged preferably in a first direction between the first edge zone and the second edge zone.

It is particularly advantageous for the division of the perforated region to be constructed in expectancy that, while shaving a region of skin, there will be a higher contact pressure of the shaving foil against the region of skin in the central zone of the perforated region than in the first edge zone and in the second edge zone. This means that small holes are formed in the areas in which a high contact pressure is expected and large holes are formed in those areas in which a low contact pressure is expected. Because the skin arches into the holes all the more intensively with increasing contact pressure and growing hole size, a high contact pressure can be compensated for by small hole sizes and can therefore act against the skin arching into the holes of the shaving foil with varying intensity. Accordingly it is possible, throughout the region of contact between the shaving foil and the skin, to obtain an optimum value for the arching of the skin into the holes and thereby provide a shave that is both thorough and gentle on the skin.

In some implementations of the shaving foil, the perforated region includes a curvature which has its zenith in the central zone. Depending on whether the shaving apparatus is equipped with one or more shaving foils of this type, the highest contact pressure during shaving occurs at or in the proximity of the zenith of the curvature so that small holes in the vicinity of the zenith are advantageous. In particular when a shaving apparatus is equipped with several shaving foils it may be advantageous for the central zone to be provided asymmetrically to the zenith of the curvature and/or for the floating mean value for the size of the holes outside the zenith to have a minimum value.

Preferably, the shaving foil is securely mounted in a foil frame adapted to be fixed on the shaving apparatus. This enables easy handling of the shaving foil and guarantees a defined geometry of the individual zones of the shaving foil after the foil frame is fixed to the shaving apparatus. At least one more shaving foil can be mounted in the foil frame.

It is particularly advantageous for the bars to have a width which is the same throughout the perforated region. Consequently, changes to the mechanical properties of the shaving foil are kept small. This facilitates, for example, compliance with a desired shape of the curvature of the shaving foil.

In some implementations of the shaving foil, at least some of the holes have different shapes. This has a positive effect on the threading behavior of the shaving foil and opens up diverse possibilities for the arrangement of the holes and the realization of a desired distribution of hole sizes. In particular it is possible to maintain a constant bar width even in the presence of varying hole sizes. Preferably, at least some of the holes are formed as irregular polygons. Furthermore it is an advantage if the size of at least some of the holes varies in accordance with a statistical distribution. This enables good use to be made of the area in the perforated region of the shaving foil.

The floating mean value for the size of the holes may vary along the first direction within the perforated region in accordance with a predefined function. The predefined function may have in particular a continuous characteristic. In this way it is possible to achieve a good adaptation to the continuous characteristic of the shaving foil contact pressure against the region of skin. The floating mean value for the size of the holes may be constant along a second direction within the perforated region. In this case the shaving foil is constructed preferably such that the first direction and the second direction are at right angles to each other. Furthermore the shaving foil is constructed preferably such that the second direction extends parallel to a provided direction of movement of a shaving cutter cooperating with the shaving foil. The first direction extends preferably at right angles to a provided direction of movement of a shaving cutter cooperating with the shaving foil. This means that the size of the holes varies preferably in a direction perpendicular to the direction of movement of the shaving cutter.

At least some of the holes may be statistically distributed over at least a sub-region of the perforated region and/or be constructed as polygons with shapes varying in accordance with a statistical distribution. Furthermore the shaving foil may be constructed such that the holes in the central zone, in the first edge zone and/or in the second edge zone have at least a predetermined minimum relative distance with regard to their center points. In this way it is possible to avoid the shaving foil having holes which due to lack of size make no noteworthy contribution to the shaving result.

The holes of the shaving foil are formed preferably as polygons whose internal angles are smaller than 180°. At least some of the holes may be formed as Voronoi polygons. Forming the holes as Voronoi polygons enables a simple design of the shaving foil accompanied by good cutting properties.

The mean values for the size of the holes may be formed as arithmetic means. The floating mean values for the size of the holes at varying locations of the perforated region may be formed as an averaging of the holes in a predetermined subarea or as an averaging of a predetermined number of holes with a predefined neighborhood relationship.

In another aspect, an electric shaving apparatus includes a shaving foil described herein.

Another aspect includes a method of manufacturing a shaving foil for an electric shaving apparatus, with the shaving foil having a perforated region which has a plurality of holes that are separated from each other by bars. Formed within the perforated region are at least a central zone, a first edge zone and a second edge zone, with the central zone being arranged between the first edge zone and the second edge zone. The method is characterized by assigning the holes in the central zone an average size which is smaller than the average size of the holes in the first edge zone and in the second edge zone and/or by forming the holes such that a floating mean value for the size of the holes in the central zone is smaller than that in the first edge zone and in the second edge zone.

Within the scope of the method, it is possible to determine a distribution of areas which adjoin each other coherently, and the holes in the central zone, the first edge zone and/or the second edge zone of the shaving foil may be constructed in accordance with the determined distribution. In this way it is possible to achieve an optimum utilization of the perforated region of the shaving foil. When determining the distribution of areas for a zone it is possible to take into account at least in some regions the distribution of the areas in a neighboring zone. This enables, for example, a seamless transition between the zones. The areas may be shaped in the form of polygons, in particular Voronoi polygons.

To design the areas it is possible to create a distribution of generator points. In particular the generator points may be created at statistically determined locations. When creating the generator points it is possible to observe at least one boundary condition. In particular it is possible, when creating the generator points of a zone, to observe at least one boundary condition regarding the generator points of a neighboring zone. This enables the areas of neighboring zones to be adapted to each other. For example it is possible, when creating a new generator point, to observe a minimum relative distance to all the previously created generator points. The sides of the areas may be determined as sections of mid-perpendiculars between generator points.

In particular it is advantageous for the regularity of the distribution of the areas to be increased iteratively. In this way it is possible to design, on the basis of the same method, distributions with variously pronounced regularity. In detail it is possible to proceed by determining the centroids of the areas with each iteration and using them as new generator points. In this case the determination of centroids may be based on an inhomogeneous mass density. In this way a desired distribution of the size of the areas may be created using the specified characteristic of the mass density.

In the region of the sides of the areas, the bars may be provided with a predetermined width.

Preferably, the size of the holes whose bars engage the skin while a region of skin is being shaved by suitable manipulation of the shaving apparatus is selected in dependence upon the position of the holes in the perforated region of the shaving foil, such that the skin arches to a uniform depth into the holes. In this way the same thoroughness is achieved in the region of all the holes involved in the shave. In particular it is possible for the size of the holes to be determined using the equation $$r = \frac{r_{min}}{\sqrt{1 - \frac{\sin^2(\gamma - \gamma_{max})}{a_2^2}}}$$

where r is the radius of a circle whose surface area corresponds to the surface area of the hole at angle $\gamma$, $r_{min}$ is the radius of a circle whose surface area corresponds to the surface area of a hole at angle $\gamma_{max}$, $\gamma$ is an azimuth angle relative to a zenith of a curvature of the shaving foil, and $a_2$ and $\gamma_{max}$ are fit parameters.

Features will be explained in more detail in the following with reference to the accompanying drawings.

DETAILED DESCRIPTION

Figure 1:
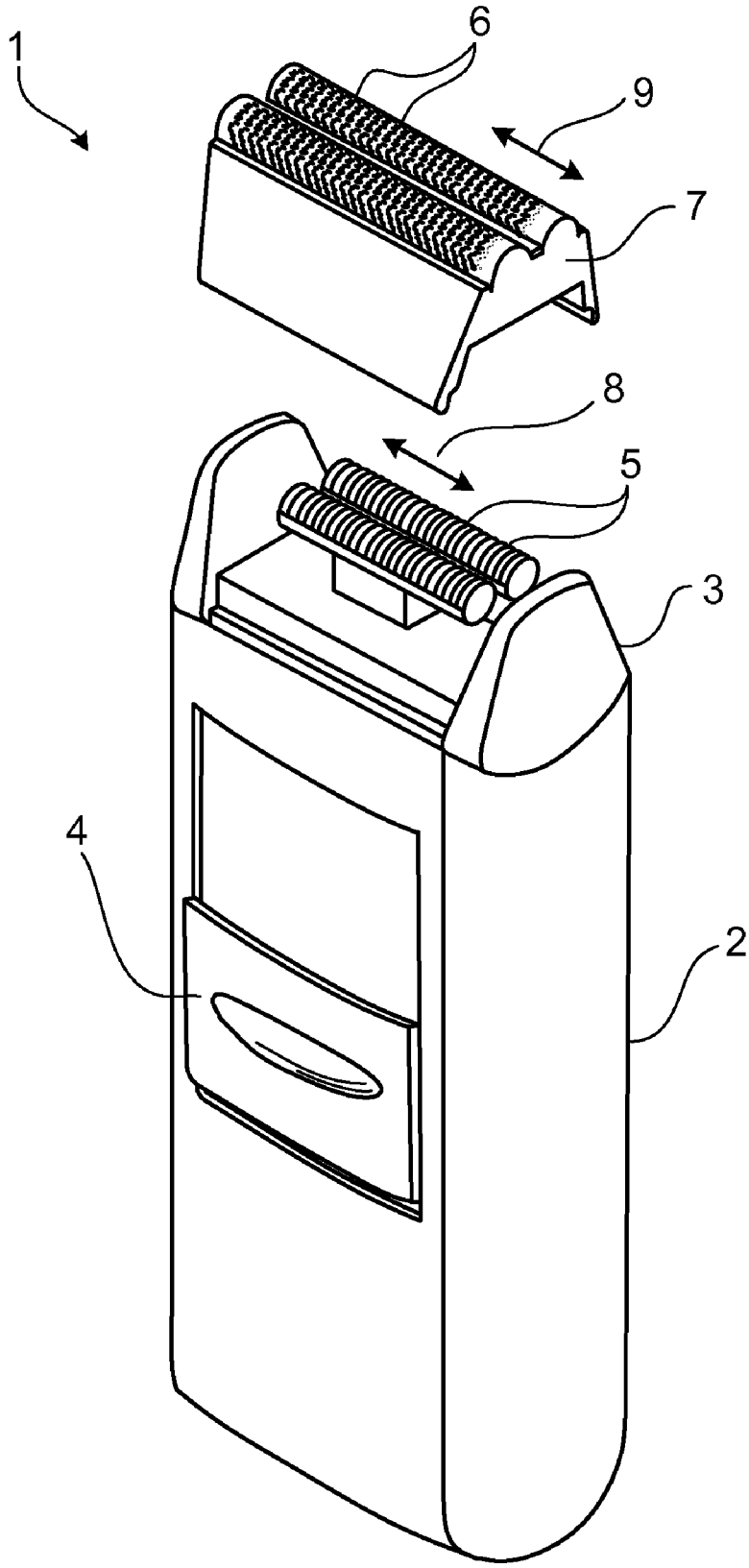
FIG. 1 is a perspective view of an electric shaving apparatus.

FIG. 1 shows an electric shaving apparatus 1 in a perspective representation. The shaving apparatus 1 includes a housing 2, which can be held in the hand, and a shaving head 3 attached thereto. Arranged on the housing 2 is a switch 4 for switching the shaving apparatus 1 on and off. The shaving head 3 has two undercutters 5, each of which includes a plurality of individual blades.

Also shown in FIG. 1 are two shaving foils which are secured to a foil frame 7. The foil frame 7 forces the shaving foils 6 into a curved shape which conforms to the contour of the undercutters 5. The foil frame 7 is designed such that together with the two shaving foils 6 it can be fixed to and readily removed from the shaving head 3. In FIG. 1 the foil frame 7, together with the two shaving foils 6, has been removed from the shaving head 3.

In the operating mode of the shaving apparatus 1, the undercutters 5 are set in a linear oscillating motion relative to the shaving foils 6 by an electric motor, which is arranged inside the housing 2. The undercutters 5 move parallel to their main extension in a direction of motion 8 which is represented by a double arrow. Another double arrow serves to illustrate a cutting direction 9 of the shaving foils 6. Given the curved shape of the shaving foils 6 illustrated in FIG. 1, their cutting direction 9 extends parallel to the axis of curvature. When the shaving foils 6 are fitted to the shaving head 3 of the shaving apparatus 1, the cutting direction 9 of the shaving foils 6 coincides with the direction of motion 8 of the undercutters 5.

The movement of the undercutters 5 relative to the shaving foils 6 results in hairs, which penetrate through one of the perforated shaving foils 6 as far as the associated undercutter 5, being captured by the undercutter 5 and severed in cooperation with the shaving foil 6.

The shaving apparatus 1 illustrated in FIG. 1 may be modified or developed further in a wide variety of ways. For example, the shaving apparatus 1 may include only one undercutter 5 and one shaving foil 6. Furthermore, the shaving apparatus 1 may have additional cutting devices such as a middle cutter, a long-hair trimmer, etc. Also, the shaving head 3 may include, for example, at least one rotary undercutter 5 and at least one circular shaving foil 6 with an annular region which encloses a circular region and is formed in a raised or recessed relationship thereto.

Figure 2:
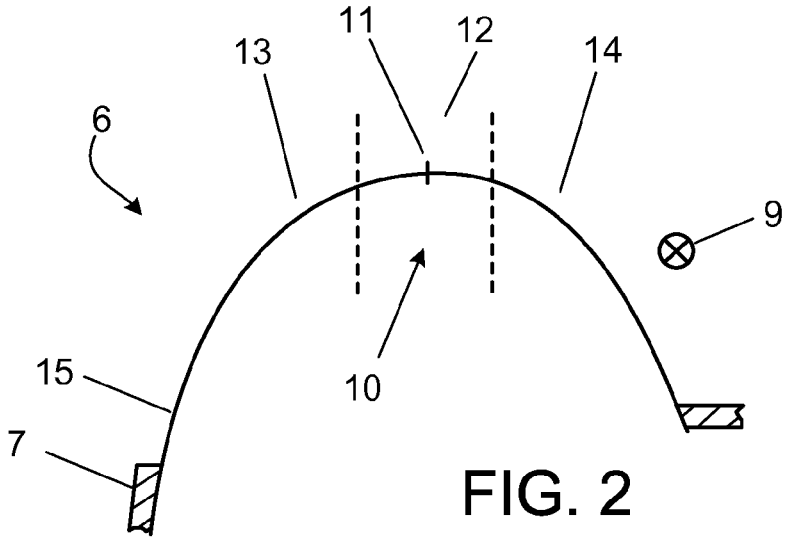
FIG. 2 is a sectional view of one of the shaving foils of FIG. 1.

FIG. 2 shows one of the shaving foils 6 of FIG. 1 in a sectional view. The section extends transversely through the shaving foil 6 so that the cutting direction 9 of the shaving foil 6 is at right angles to the plane of projection. The shaving foil 6 has a curvature 10 with a zenith 11. In the representation of FIG. 2, the zenith 11 is the highest elevation of the shaving foil 6. On a shaving apparatus 1 having several shaving foils 6, the zenith 11 of each shaving foil 6 is defined by the line of contact between a plane engaging all the shaving foils 6 tangentially and the respective shaving foil 6.

With proper manipulation of the shaving apparatus 1, the shaving foil 6 has the region of its zenith 11 in engagement with the skin during the shaving operation. As a result of the skin's elasticity, the regions of the shaving foil 6 adjacent to the zenith 11 also have contact with the skin. For the following observations, the shaving foil 6 is divided into several zones. A central zone 12 contains the zenith 1 and an adjoining region on either side. Adjacent to the central zone 12 on the one side is an edge zone 13 and on the other side an edge zone 14. The central zone 12, the two edge zones 13 and 14 and, where applicable, further zones combine to form a perforated region 15 of the shaving foil 6. The configuration of the shaving foil 6 within the perforated region 15 will be explained in more detail in the following.

Figure 3:
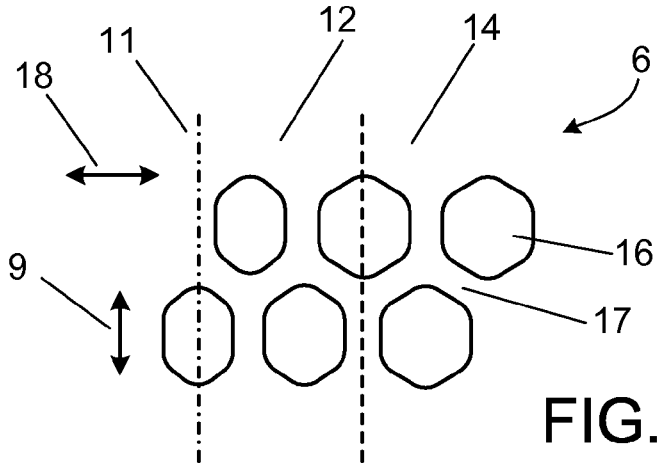
FIGS. 3 to 6 are partial views of a shaving foil.

FIG. 3 shows a shaving foil 6 in a partial representation. The shaving foil 6 includes a plurality of holes 16 which are separated from each other by respective bars 17. As shown, the holes 16 are shaped in a hexagonal configuration. In this arrangement, holes 16 in the region of the central zone 12 have a smaller area than those in the region of the edge zone 14. The relationships in the edge zone 13, not shown, correspond to those in the edge zone 14 shown. The difference in size among the holes 16 comes about because the hexagons have different extensions in a direction parallel to a transverse direction 18 of the shaving foil 6, which is indicated by a double arrow and extends perpendicularly to the cutting direction 9. The bars 17 have the same width in the central zone 12 and in the edge zone 14.

The shaving foil 6 of arched shape may be regarded in simplified terms as a rigid cylinder which during the shaving operation is pressed in the region of the zenith 11 of the curvature 10 against the skin. The skin then represents an elastic medium. As a result, the skin yields elastically and nestles up against the curvature 10 of the shaving foil 6. Also, the skin arches into the holes 16 of the shaving foil 6. The intensity of arching of the skin into the holes 16 of the shaving foil 6 depends on the local pressure at which the shaving foil 6 is pressed against the skin and on the geometry of the holes 16. This means, for example, that with a constant size of holes 16 the skin will arch more intensively into the holes 16 as the local pressure increases.

An intensive arching of the skin into the holes 16 of the shaving foil 6 results in a particularly thorough shave because the hairs are severed close to the skin. However, the risk of skin irritations also increases in particular when there is contact between the skin and the undercutter 5. According to the invention, holes 16 with small dimensions are provided therefore at those locations of the shaving foil 6 at which a high local pressure occurs during the shaving operation. Holes 16 with large dimensions are arranged at those locations of the shaving foil 6 at which a low local pressure occurs during the shaving operation. In this arrangement, the holes 16 are usually selected large enough for the skin not to touch the undercutter 5.

According to the theory of Hertzian contact stress, the pressure is at its maximum in the center of the contact area of the cylinder, i.e., in the region of the zenith 11 of the curvature 10 of the shaving foil 6, decreasing in outward direction. Accordingly, the holes 16 in the central zone 12, in the center of which the zenith 11 of the curvature 10 is arranged, are made smaller than in the edge zones 13 and 14. This means that the increased local pressure in the central zone 12 is compensated for by a reduced size of the holes 16. In the edge zones 13 and 14, in which the local pressure is smaller than in the central zone 12, provision is made for larger holes 16 than in the central zone as compensation. On the whole such a distribution of sizes of the holes 16 results in smaller differences in terms of the arching of the skin into the holes 16 of the shaving foil 6 than would be the case with a uniform size of the holes 16 in the central zone 12 and in the edge zones 13 and 14. This means in turn that similar results in terms of the thoroughness of the shave and the protection of the skin are achieved in all zones. Compared to a constant size of the holes 16, it is thus possible to achieve better protection of the skin with the same thoroughness of the shave or greater thoroughness of the shave with the same level of skin protection. As a result of the larger holes 16 in the edge regions, it is easier in addition for the hairs to thread into the shaving foil 6, thus improving the efficiency of the shaving.

The foregoing statements are based on the shaving apparatus 1 being handled during shaving such that on a shaving apparatus 1 having a single shaving foil 6, the zenith 11 of the curvature 10 lies laterally approximately centrally in the contact region which is formed between the shaving foil 6 and the skin surface. Compliance with this geometry can be facilitated for the user of the shaving apparatus 1 by providing an additional shaving assembly and a pivot mechanism which moves the shaving foil 6 into the mentioned orientation. The pivot mechanism may be implemented, for example, by a pivotal mounting of the shaving foil 6 or of the entire shaving head 3 on the housing 2 of the shaving apparatus 1.

As will explained in greater detail in the following, a similar condition applies for a shaving apparatus 1 having several shaving foils 6, in which the zenith 11 of the curvature 10 no longer lies exactly in the center of the respective contact surface on account of the action of several shaving foils 6 on the skin. A shaving apparatus 1 equipped with several shaving foils 6 is handled during shaving such that all the shaving foils 6 make contact with the skin. This boundary condition makes the correct handling of the shaving apparatus 1 relatively easy for the user. For further simplification it is also possible to provide the previously described pivot mechanisms.

Figure 4:
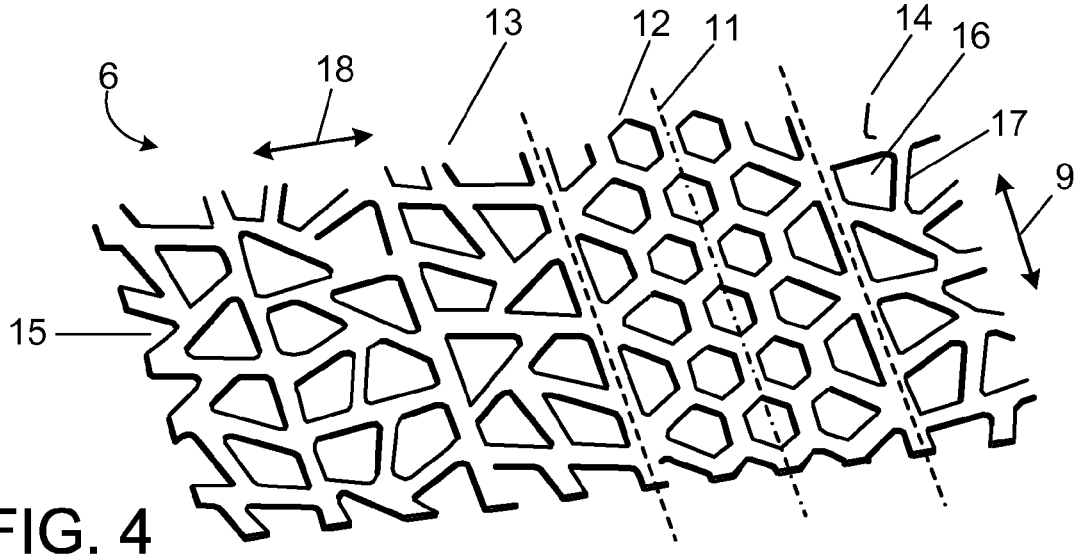

FIG. 4 shows another shaving foil 6 in a perspective view of a partial development. Similarly, in this shaving foil, smaller holes 16 are formed in the central zone 12 of the shaving foil 6 than in the edge zones 13 and 14, with the width of the bars 17 in the central zone 12 and in the edge zones 13 and 14 being the same. Unlike in FIG. 3, however, not all the holes 16 are formed as hexagons. Hexagons are provided solely in the central zone 12. Furthermore, the central zone 12 also includes different polygons. Similarly, the edge zones 13 and 14 have different polygons. With polygons of different shape it is possible to improve the thoroughness of the shave even further.

Figure 5:
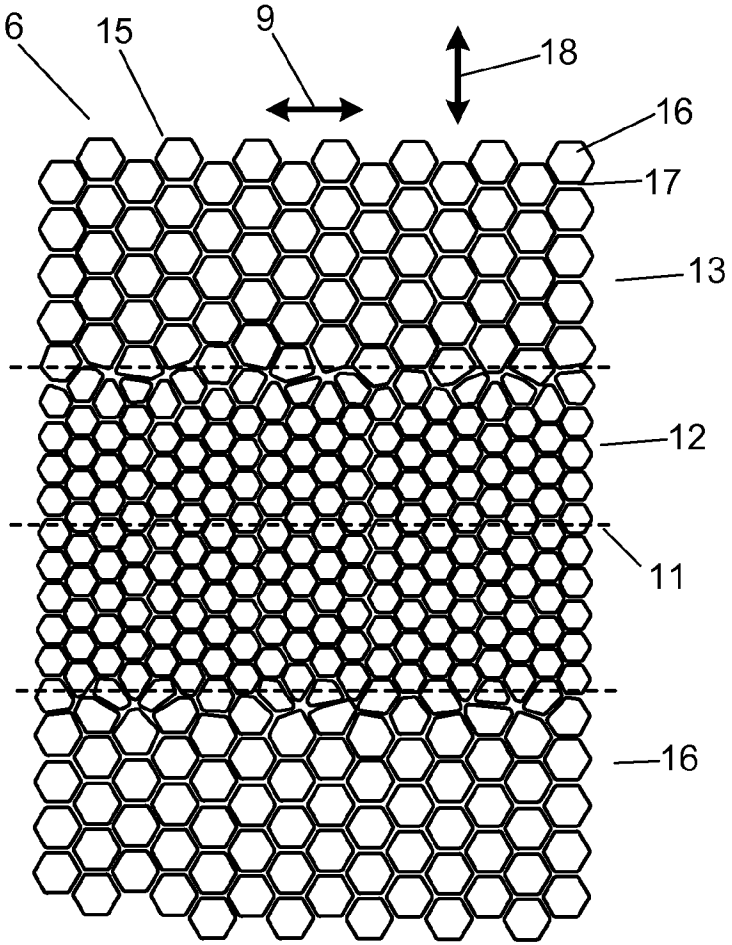

FIG. 5 shows a shaving foil 6 in a partial view. In this shaving foil the holes 16 in the central zone 12 and in the edge zones 13 and 14 of the shaving foil 6 have a hexagonal shape, with the holes 16 in the central zone 12 being somewhat smaller than in the edge zones 13 and 14. In the region of the transitions between the edge zones 13 and 14 and the central zone 12, both the size and the shape of the holes 16 vary. Hence the transitional regions represent an interface between two regularly arranged regions within which the respective holes 16 are identically formed. In the regularly arranged regions on either side of the interface the holes 16 are differently formed, however. In the region of the interfaces, the shaving foil 6 displays greater rigidity. This causes a deviation from a desired shape of the curvature 10 and therefore to increased wear.

Figure 6:
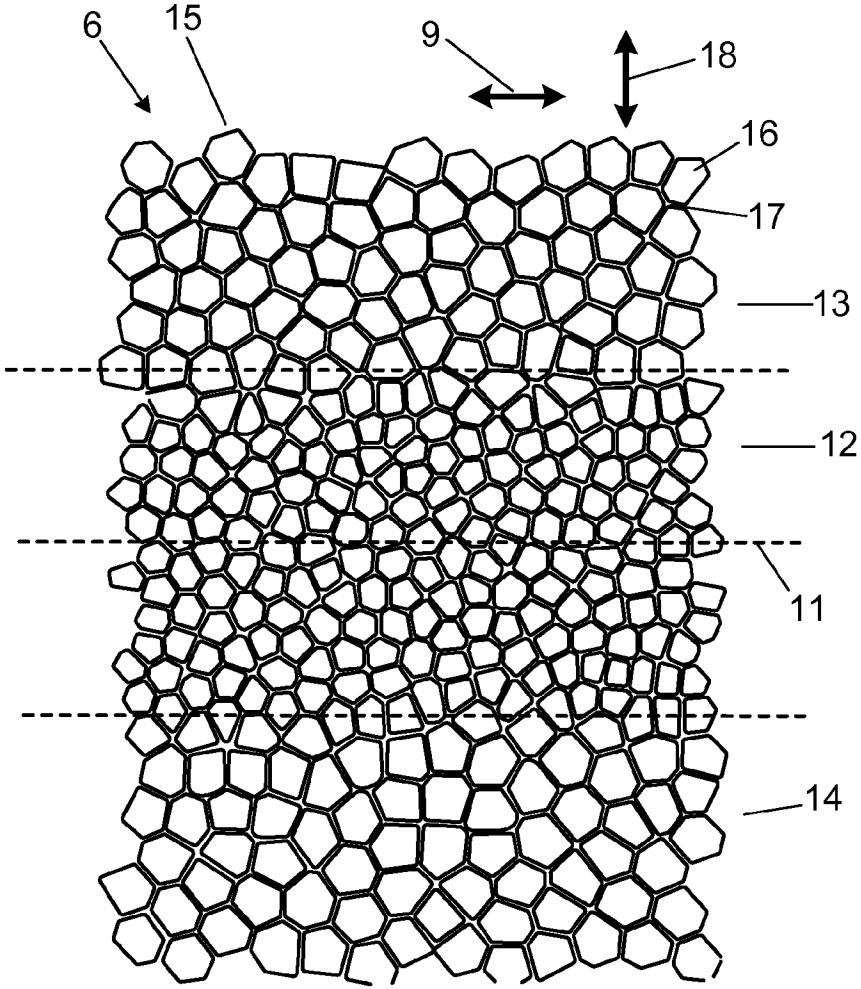

FIG. 6 shows a shaving foil 6 in a partial view. This shaving foil is characterized in that the holes 16 in the central zone 12 and in the edge zones 13 and 14 are irregularly arranged and have different shapes and different sizes. The sizes of the holes 16 vary such that the arithmetic mean of the areas of the holes 16 in the central zone 12 is smaller than in the two edge zones 13 and 14. Through such shaping it is possible to dispense with any interface being formed between the edge zones 13 and 14 and, respectively, the central zone 12. This results in a more uniform curvature 10 and accordingly in an improvement of the wear characteristic.

The formation of the mean value, for example the computation of the arithmetic mean, enables in the case of varying hole sizes a systematic description of the hole size distribution and can be performed over the entire area of the central zone 12 and, respectively, the edge zones 13 and 14. For a detailed analysis it is also possible to draw on a floating mean value for the hole size. The floating mean value can be determined as the arithmetic mean of the hole sizes within a predefined sub-area. This takes into account all the holes 16 which are arranged fully or to a predetermined fraction within the sub-area. The sub-area may be formed, for example, as a square or a circle. Similarly, the sub-area may also be formed as an elongated rectangle which extends parallel to the cutting direction 9 over the entire perforated region 15 of the shaving foil 6 and has, parallel to the transverse direction 18, dimensions in the range of the size of one hole 16 or a few holes 16. This enables good formation of the mean value and at the same time a high resolution for the description of the size variation of the holes 16 parallel to the transverse direction 18. A similar effect can also be achieved by including in the formation of the mean value all the holes 16 which are intersected by a line extending parallel to the cutting direction 9. Rather than predefining a sub-area, it is also possible to use as basis for the formation of the mean value a fixed number of holes 16 which stand in a predetermined neighborhood relationship to the point for which the mean value is to be computed. For example, it is possible to draw on a predefined number of holes 16 whose center points have the smallest distances from the point. Unless stated otherwise, these variants for the formation of the mean value are also applicable to the shaving foils 6 described in the following and apply also to other shaving foils 6 which are not explicitly described.

An arrangement of holes 16 may be generated, for example, by means of a method which originated from the Russian mathematician Georgi F. Voronoi. The related theory is described in G. Voronoi: "Recherches sur les Parallèloèdres Primitives", Journal für die reine und angewandte Mathematik, vol. 134, pp. 198-287 (1908). In addition, other approaches which supply a suitable irregular or aperiodic arrangement of holes 16 are possible.

The Voronoi division of the plane, with which the arrangement of holes 16 illustrated in FIG. 6 was created, will be described in greater detail below. Details of this method can be found in A. Okabe, B. Boots and K. Sugihara: "Spatial Tesselations—Concepts and Applications of Voronoi Diagrams", published by John Wiley & Sons (1992), ISBN 0 471 93430 5.

FIGS. 7 to 10 show snapshots during the generation of a Voronoi diagram.

Figure 7:
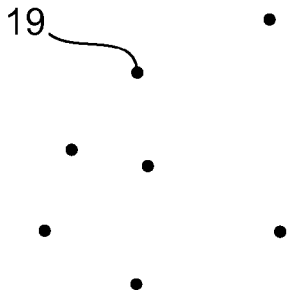
FIGS. 7 to 10 are snapshot views taken during the creation of a Voronoi diagram.

As shown in FIG. 7, for example, statistically distributed generator points 19 are initially generated in a plane. Then each generator point 19 is assigned a surrounding region in which each area element is closer to the respective generator point 19 than to any other generator point 19. These surrounding regions have the shape of a polygon, which in the following is also referred to as a Voronoi polygon. The Voronoi polygons cover the entire plane coherently, thus resulting in a tessellation of the plane. If the generator points 19 are periodically arranged, the Voronoi polygons cover the plane with a periodic pattern. In the case of an aperiodic arrangement of the generator points 19, the pattern of the Voronoi polygons is also aperiodic. An area-filling arrangement of Voronoi polygons is also called a Voronoi diagram in the following.

Figure 8:
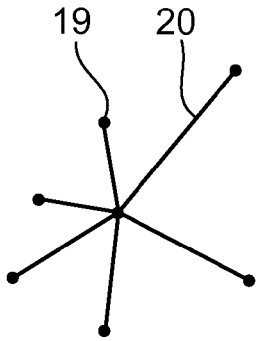

One possibility of creating the Voronoi polygons is to provide connecting lines 20 from each generator point 19 to all neighboring generator points 19. This is shown in FIG. 8.

Figure 9:
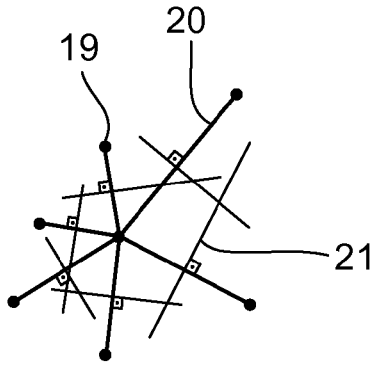

Then for each connecting line 20, a mid-perpendicular 21 is determined which extends orthogonally to the respective connecting line 20 and intersects the connecting line 20 in the center between the connected generator points 19. This is shown in FIG. 9.

Figure 10:
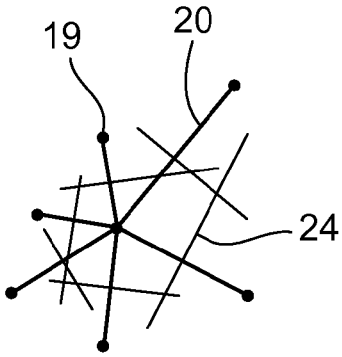

The mid-perpendiculars 21 also intersect each other. The points of intersection of the mid-perpendiculars 21 form the corner points of the Voronoi polygons. The Voronoi polygons created in this way are shown in FIG. 10. The Voronoi polygons have a convex shape, i.e., the internal angles of their corners are smaller than 180°.

To manufacture shaving foils 6 on the basis of Voronoi polygons, the sides of the Voronoi polygons are formed as bars 17 with a predetermined width. The areas of the Voronoi polygons remaining between the bars 17 are formed as holes 16.

The configuration of the Voronoi diagrams depends on the arrangement of the generator points 19. Distributing the generator points 19 statistically in the plane produces Voronoi diagrams which contain a great variation of Voronoi polygons from very small to very large surface areas. Such Voronoi diagrams are too irregular as a basis for the construction of shaving foils 6. Provision is made therefore for drawing on Voronoi diagrams which display greater regularity. Such Voronoi diagrams can be created, for example, by means of a method known as the "simple sequential inhibition process" (see H. X. Zhu, S. M. Thorpe and A. H. Windle: "The geometrical properties of irregular two-dimensional Voronoi tessellations", Philosophical Magazine A, vol. 81, no. 12, pp. 2765-2783 (2001)). Using this method, a first generator point 19 is first arranged at random in the plane. Then the position of another generator point 19 is determined at random. If the other generator point 19 lies too closely to the first generator point 19, the other generator point 19 is discarded and its position newly determined. This process is repeated until the other generator point 19 has at least a fixedly predetermined minimum distance d from the first generator point 19.

The other generator points 19 are determined in the same way, with a check being carried out to make sure that the minimum distance d is maintained from all the already existing generator points 19. Only if this condition is satisfied will the newly determined generator point 19 be accepted. This means that on determining the $n^{th}$ generator point 19 a check is carried out to make sure that the minimum distance d is maintained from all n-1 generator points 19 previously determined. Geometrically this approach corresponds to the generation of a random distribution of circular disks whose respective center points are generator points 19 and whose diameters 5 correspond to the predefined minimum distance d, with the circular disks being not allowed to overlap. The largest possible minimum distance d can be obtained by generating a hexagonal arrangement of circular disks. This would correspond to a periodic arrangement of Voronoi polygons which are formed as identical regular hexagons, with the inscribed circle diameter $d_{hexagon}$ of each hexagon, i.e., the two-fold distance of the sides to the center point of the hexagon, corresponding to the minimum distance d.

Given a predefined total area A and a predefined number n of generator points 19, the area F per Voronoi polygon is:

$$F = \frac{A}{n}. \tag{A}$$

The area $F_{hexagon}$ of a hexagon with an inscribed circle diameter $d_{hexagon}$ equals:

$$F_{hexagon} = \frac{\sqrt{3}}{2} d_{hexagon}^2. \tag{B}$$

Thus the maximum possible minimum distance d in this case equals:

$$F_{hexagon} = \frac{\sqrt{3}}{2} d_{hexagon}^2. \tag{C}$$

Consequently, values for the minimum distance d can be predefined in the range $0 \leqq d \leqq d_{hexagon}$. The Voronoi diagram is formed all the more regularly the larger the value for the minimum distance d is predefined. As a measure of the regularity of a Voronoi diagram it is possible to define a regularity parameter α as the ratio of the minimum distance d to the inscribed circle diameter $d_{hexagon}$ of the hexagon which represents the maximum possible minimum distance d:

$$\alpha = \frac{d}{d_{hexagon}}. \tag{D}$$

With a completely statistical configuration of the Voronoi polygons, the minimum distance d equals zero. Thus the regularity parameter α also has the value 0. With a completely regular configuration of the Voronoi polygons, the minimum distance d equals the inscribed circle diameter $d_{hexagon}$ Thus the regularity parameter α then has the value 1.

Figure 12:
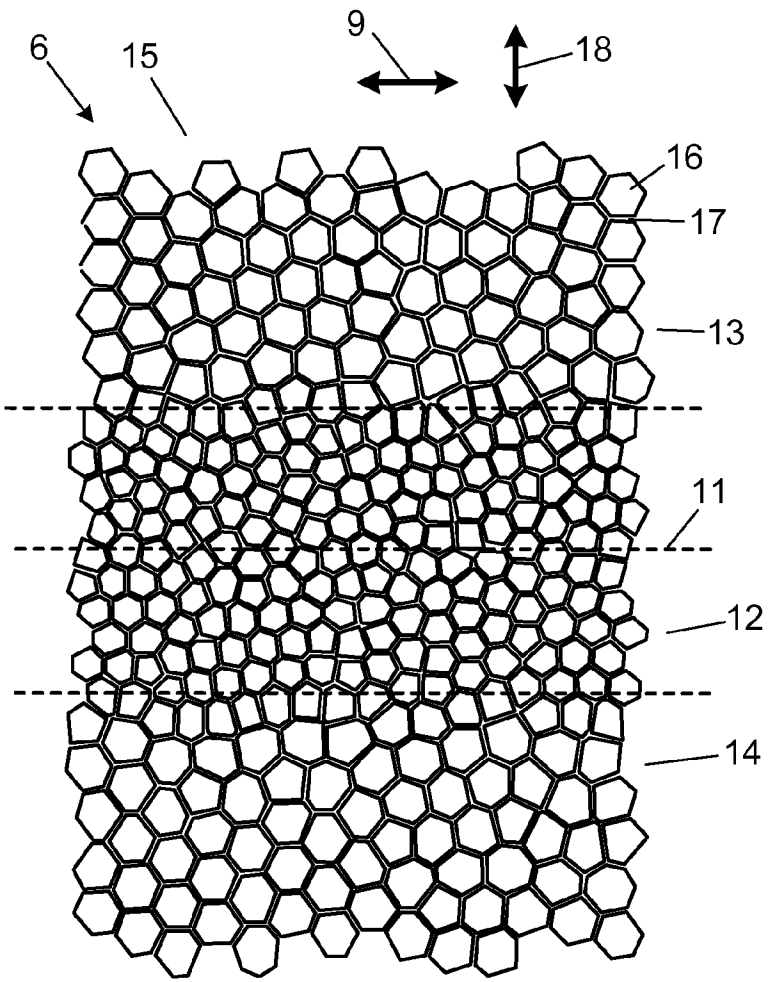
FIGS. 11 to 13 are partial views of shaving foils.
Figure 11:
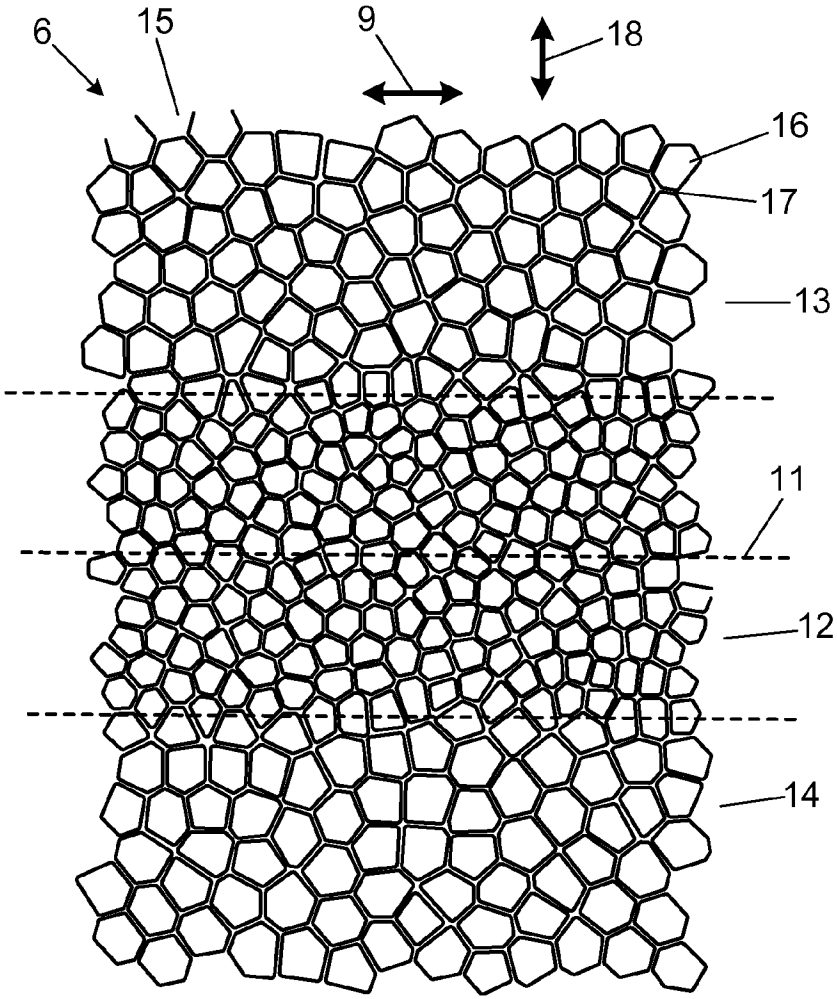

Shaving foils 6 based on Voronoi diagrams with different regularity parameters α are shown in FIGS. 11 and 12.

FIGS. 11 and 12 show further shaving foils 6 in a developed partial view. In FIGS. 11 and 12 the holes 16 of the shaving foil 6 are formed as Voronoi polygons which have a smaller average surface area within the central zone 12 than within the edge zones 13 and 14. Furthermore, the edge zones 13 and 14 merge seamlessly with the central zone 12.

In the shaving foil of FIG. 11, the regularity parameter α has a value of 0.7 in each segment. In the shaving foil of FIG. 12, the regularity parameter α has a value of 0.8 in each segment. Accordingly, the shaving foil 6 in FIG. 12 has in the various zones a more regular pattern than the shaving foil 6 of FIG. 11. This applies with regard to both the surface area and the shape of the Voronoi polygons.

To create a pattern for a shaving foil 6 with several zones, first the generator points 19 within one of the zones, for example within the central zone 12, are determined. Then the generator points 19 of a neighboring zone, for example the edge zone 13, are determined. At the same time, a check is carried out to ensure that the minimum relative distance d to the generator points 19 of the currently and the previously processed zone is maintained. The process is repeated similarly for the processing of the other zones. At the same time a check is carried out to ensure that for each newly determined generator point 19 the minimum relative distance to all the previous generator points 19 of the currently and all the previously processed zones is maintained. Each zone may have its own predefined regularity parameter α. Similarly, it is also possible to predefine the same regularity parameter α for all zones. In the zone processed first it is also possible for the generator points 19 to be arranged periodically or quasi periodically. If there is to be a seamless merging with the other zones, then the generator points 19 in the other zones are not arranged periodically or quasi periodically.

It is possible, when creating Voronoi diagrams for a shaving foil 6, to omit the previously described predefinition of the minimum distance d between the generator points 19 and therefore to begin by creating a statistical distribution of Voronoi polygons. The pattern thus created will be referred to as a Poisson Voronoi pattern in the following. Then the centroid is computed for each Voronoi polygon. The computed centroids form the generator points 19 of a new Voronoi diagram. The Voronoi polygons of the new Voronoi diagram are more uniform than the Voronoi polygons of the Poisson Voronoi pattern on which they are based. Centroids can be computed in turn likewise for the new Voronoi polygons and be used as new generator points 19. This process can be continued iteratively for as long as the Voronoi diagram is sufficiently homogeneous. In the limiting case of very many iterations, the result is approximately a Voronoi diagram which is referred to in the following as a centroid Voronoi diagram. The iterative variation of a Voronoi diagram using continued centroid formations is based on Lloyd's algorithm by Stuart P. Lloyd. For details see S. Lloyd: "Least Squares Quantization in PCM", IEEE Transactions on Information Theory, vol. 28, no. 2, pp. 129-137 (1982).

The centroid computation does not have to be based necessarily on a spatially constant mass density. It may also be based on a spatially varying mass density (see Q. Du, V. Faber and M. Gunzburger: "Centroidal Voronoi Tessellations: Applications and Algorithms", SIAM Review, vol. 41, no. 4, pp. 637-676 (1999)). In this case, the iterative process converges toward a centroid Voronoi diagram which at locations of high mass density includes Voronoi polygons with a small surface area and at locations of low mass density Voronoi polygons with a large surface area. The relationship between the mass density ρ(x,y) and the surface area F(x,y) of the Voronoi polygons is then the following:

$$F(x, y) \sim \frac{1}{\sqrt{\rho(x, y)}}. \tag{E}$$

Figure 13:
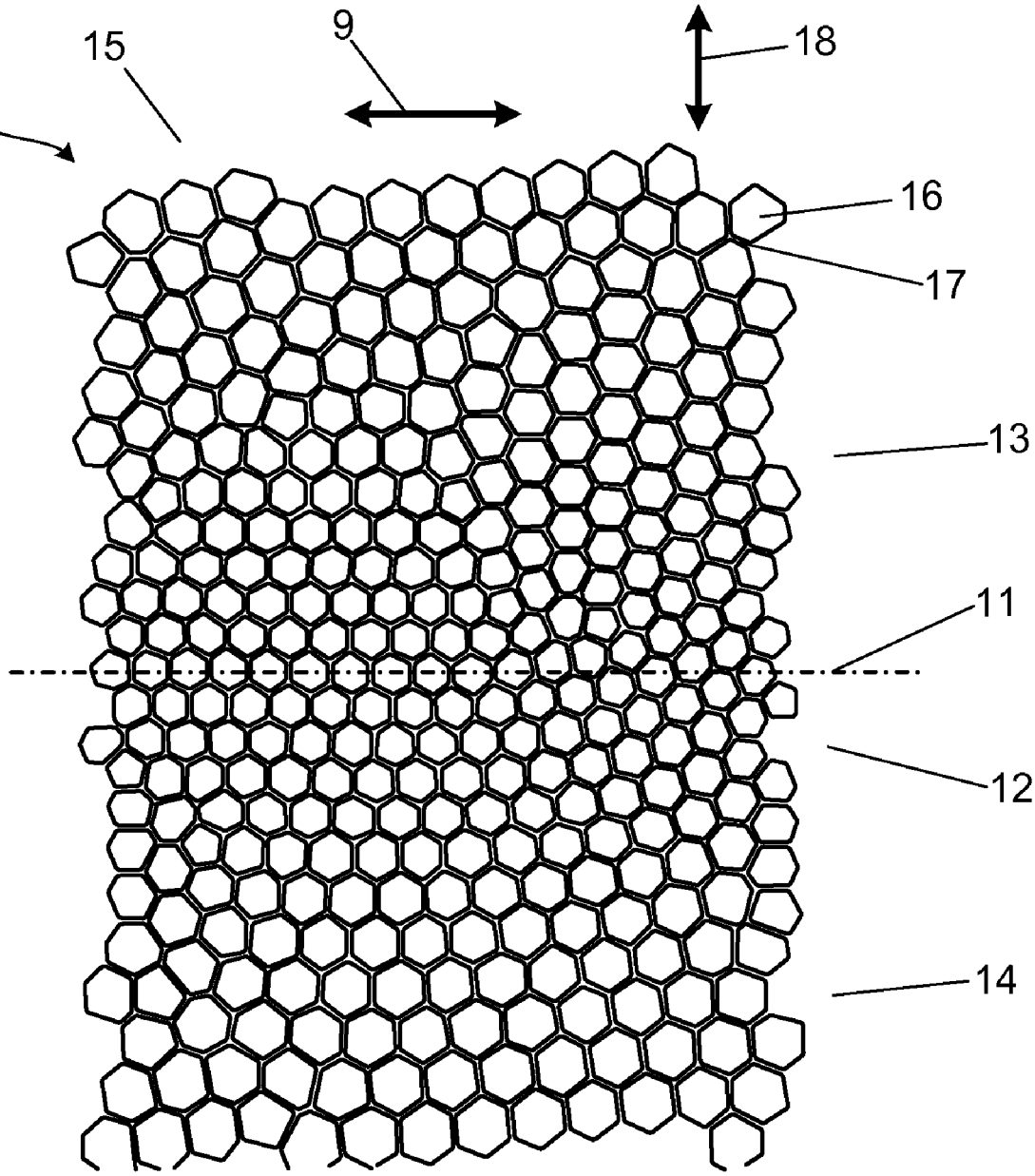

Using a corresponding predefined mass density, it is possible to generate a desired distribution of the surface area of the Voronoi polygons and thus of the size of the holes 16 of the shaving foil 6. The size of the holes 16 may vary both continuously and discontinuously. A shaving foil 6 with a continuously varying size of holes 16 is illustrated in FIG. 13. FIG. 13 shows another shaving foil 6 in a partial view. In this shaving foil, the size of the holes 16 varies continuously and has a minimum value in the region of the zenith 11 of the curvature 10. The size of the holes 16 increases as the distance from the zenith 11 increases. The characteristic according to which the size of the holes 16 varies is illustrated in FIG. 14.

Figure 14:
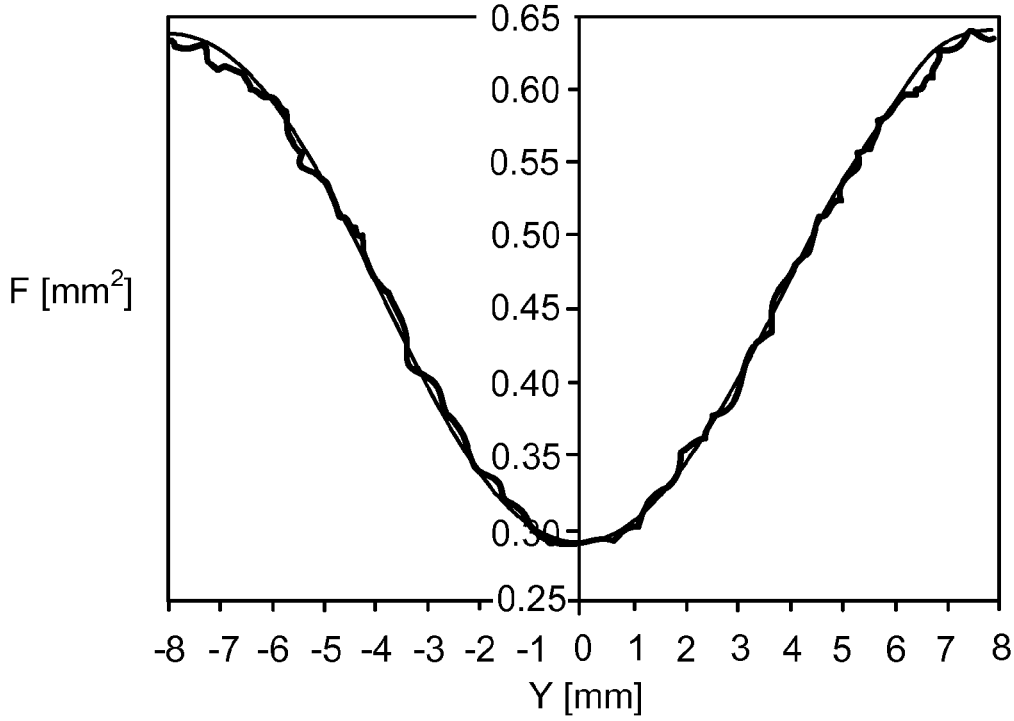
FIG. 14 is a diagram of the hole size characteristic for the shaving foil illustrated in FIG. 13.

FIG. 14 shows a diagram of the size characteristic of the holes 16 for the shaving foil illustrated in FIG. 13. Plotted on the abscissa is the relative distance y of the holes 16 to the zenith 11. Plotted on the ordinate is the size of the hole area F. Drawn as a thin line is a desired size characteristic of the hole area F, which is based on a sine function having a minimum in the region of the zenith 11 (y=0). Drawn as a thick line is the actual size characteristic of the average hole area F. As becomes apparent from FIG. 14, the actual characteristic concurs with the desired sine function in good approximation.

In the following it will be explained with which size characteristic of the holes 16 of the shaving foil 6 a particularly good shaving result can be achieved:

If the skin is regarded approximately as a homogeneous, isotropic, linear-elastic medium with semi-infinite expansion, then a shaving apparatus 1 with a single shaving foil 6 produces within the area of engagement of the shaving foil 6 with the skin a pressure q(y):

$$q(y) = \frac{E}{2R}\sqrt{b^2 - y^2} \tag{F}$$

where y is the respective distance from the zenith 11 of the curvature 10 of the shaving foil 6, E is the modulus of elasticity of the skin, R is the radius of the curvature 10 of the shaving foil 6, and b is half the width of the area of engagement in y direction, i.e., the shaving foil 6 makes contact with the skin in the region $-b \leqq y \leqq +b$. For the width 2*b* of the area of engagement the following applies:

$$2b = 4\sqrt{\frac{R \cdot P}{\pi \cdot E}}, \tag{G}$$

where P is the force per unit of length with which the shaving apparatus 1 is pressed against the skin during the shave.

Outside the area of engagement of the shaving foil 6 with the skin, the pressure q(y) has the value 0.

In approximation of a circular configuration of the holes 16 of the shaving foil 6 with a radius a, it is possible to estimate the arching of the skin into one of the holes 16 through integration of Boussinesq's solution for the impression of a point-shaped indentor over the hole. The underlying theory is disclosed in J. Boussinesq: "Application des Potentiels á l'Etude de l'Equilibre et du Mouvement des Solides Elastiques", published by Gauthier-Villars (1885). The depth D of the skin arching relative to the level of the hole 16 in the center of the hole 16 is determined as:

$$D(q) = \frac{q \cdot (1 - v^2)}{\pi E} \cdot 2\sqrt{\pi} \cdot \sqrt{F}, \tag{H}$$

where v is the transverse contraction coefficient of the skin. Factor F is a measure of the area of the hole 16. There are similar equations for square or rectangular holes 16, with a geometry factor for a square or rectangle being needed in addition to factor $2\sqrt{\pi}$. This additional factor has exactly the value 1 for a circular hole 16. For a square or rectangular hole 16 the additional factor does not have exactly the value 1 but lies close to the value 1.

In some cases, the depth D of the skin arching in a convex hole 16 with a small aspect ratio, i.e., with approximately equally long sides, depends first and foremost on the area and not on the shape of the hole 16. The above equation for the depth D of the skin arching is therefore also approximately applicable to hexagons and to Voronoi polygons.

Using a shaving apparatus 1 with two shaving foils 6 as, for example, in FIG. 1, the force with which the shaving apparatus 1 is pressed against the skin is divided over the two shaving foils 6. Hence only half the force acts on each of the two shaving foils 6. Furthermore, the impressions in the skin effected by the shaving foils 6 are mutually influencing. As a result, the maximum local pressure q is not applied in the region of the zeniths 11 of the shaving foils 6, but is offset by an azimuth angle $\gamma_{max}$ relative to said region. On a shaving apparatus 1 having two shaving foils 6, this results in the following azimuth relationship for the depth D of the skin arching into the holes 16 of the shaving foils 6:

$$D(\gamma)=r\cdot(1-\nu^2)\cdot\sqrt{a_2^2-\sin^2(\gamma-\gamma_{max})} \quad \text{(I)}$$

where γ is the azimuth angle relative to the zenith 11 of the respective shaving foil 6, r is the radius of a circle whose surface area corresponds to the surface area of the hole 16 of the shaving foil 6, i.e., $r=\sqrt{F/\pi}$. $a_2$ and $\gamma_{max}$ represent fit parameters. An example of a characteristic of the skin arching depth D is illustrated in FIG. 15.

Figure 15:
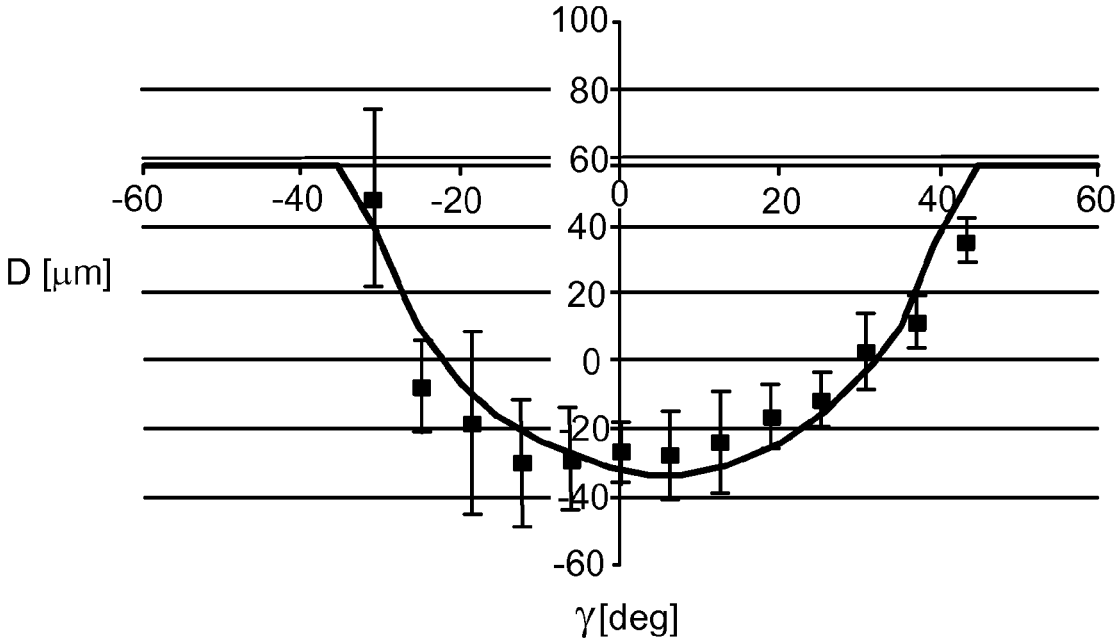
FIG. 15 is a diagram of a possible skin arching depth characteristic as a function of the azimuth angle.

FIG. 15 shows a diagram of a possible characteristic of the skin arching depth D as a function of the azimuth angle γ. Plotted on the abscissa is the azimuth angle γ; plotted on the ordinate is the skin arching depth D. The diagram relates to a shaving apparatus 1 having two shaving foils 6. The presentation is selected to reflect the relationships in the region of one of the two shaving foils 6, whereby on the left side of the diagram the other shaving foil 6 would continue with a mirror-reversed characteristic of the skin arching depth D. The plotted points represent measurement values which were determined for a test person using the shaving apparatus 1 illustrated in FIG. 1. The line drawn in full was determined by means of the above equation (I), using $a_2=0.59$ and $\gamma_{max}=5°$ as fit parameters.

In spite of the idealizations on which equation (I) is based and according to which the skin is regarded as a homogeneous, isotropic, linear-elastic medium with semi-finite expansion, the characteristic concurs relatively well with the measurement values. Equation (I) can therefore be used for determining the size of the holes 16 of the shaving foil 6 for a desired skin arching depth D. For this purpose, equation (I) is solved for radius r. It is particularly advantageous for the skin arching depth D to correspond just about to a thickness sf of the shaving foil 6. In this case the hairs are severed by the undercutter 5 directly at the skin surface, with the undercutter 5 just failing to touch the skin. Thus we obtain for r:

$$r=\frac{sf}{(1-\nu^2)\cdot\sqrt{a_2^2-\sin^2(\gamma-\gamma_{max})}}. \quad \text{(J)}$$

With $$r_{min}=\frac{sf}{(1-\nu^2)\cdot a_2}, \text{ (J) is expressible as} \quad \text{(K)}$$

$$r=\frac{r_{min}}{\sqrt{1-\frac{\sin^2(\gamma-\gamma_{max})}{a_2^2}}}.$$

By varying the surface area of the holes 16 of the shaving foil 6 as a function of the azimuth angle γ in accordance with equation (K), there results approximately a constant depth D for the arching of skin throughout the contact region between the shaving foil 6 and the skin. Because equation (K) diverges, the holes 16 of the shaving foil 6 become very large for large azimuth angles γ, i.e., at a long distance from the zenith 11. This may lead to problems when the shaving apparatus 1 is not placed perpendicularly on the skin because then a high local pressure q prevails in the region of large holes 16 and the skin arches accordingly deeply into the holes 16. This problem can be eliminated by varying the size of the holes 16 only in the vicinity of the zenith 11 or in the vicinity of the azimuth angle $\gamma_{max}$ in accordance with equation (K) and limiting it outside this vicinity to a maximum value. A shaving foil 6 constructed in such a way is illustrated in FIG. 16.

Figure 16:
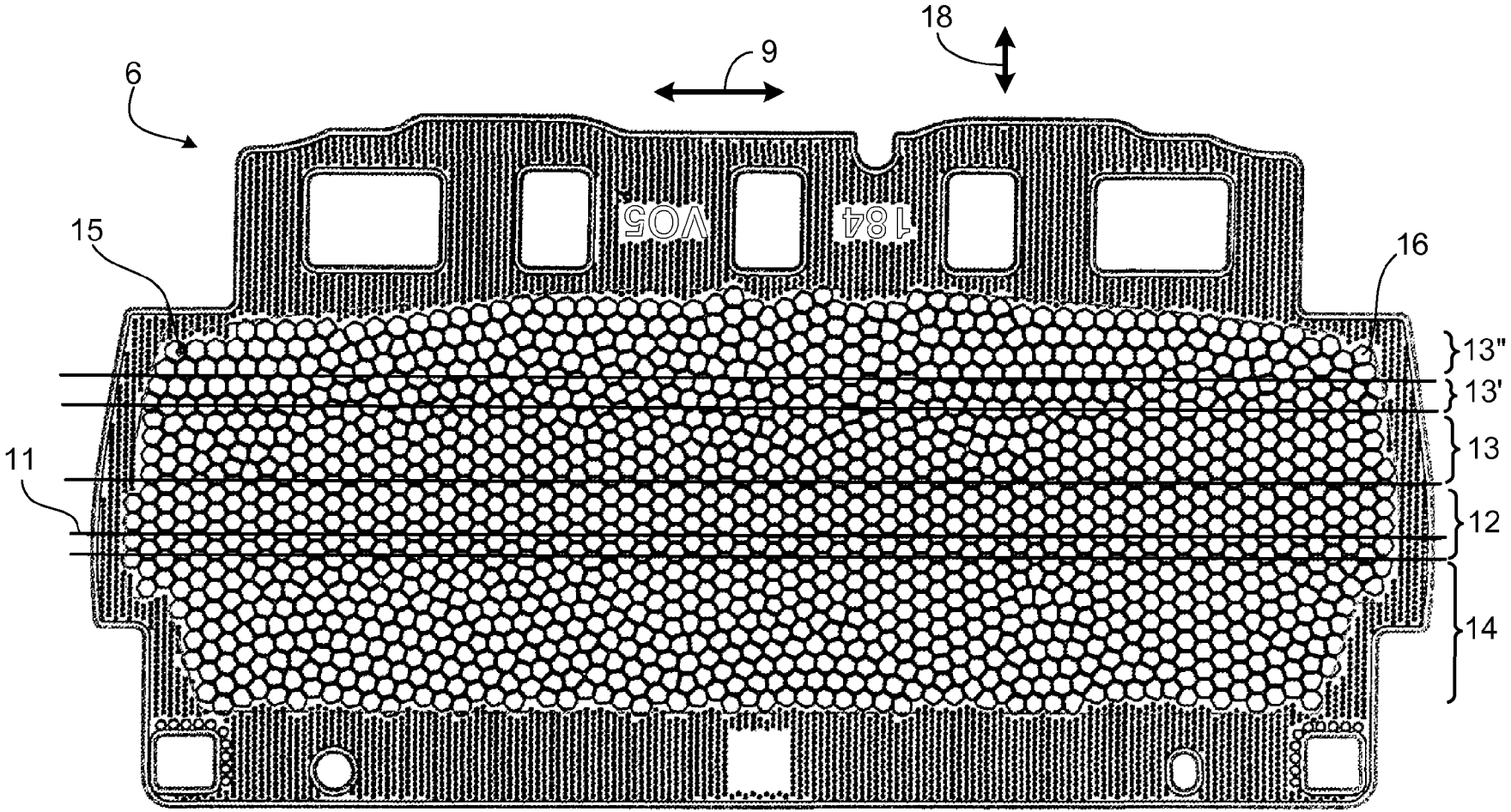
FIG. 16 is a partial view of a shaving foil.

FIG. 16 shows another shaving foil 6 in a partial view. This shaving foil is provided for a shaving apparatus 1 having two shaving foils 6. The azimuth angle $\gamma_{max}$, for which the local pressure q is maximum, equals approximately 10° and corresponds roughly to the mean elongation of a hole 16. In the central zone 12, which extends in this shaving foil symmetrically about the azimuth angle $\gamma_{max}$, the holes 16 are formed as regular hexagons. Adjoining both sides of the central zone 12 are edge zones 13 and 14, respectively, in which the holes 16 are formed as Voronoi polygons and are larger on average than in the central zone 12. The Voronoi polygons were designed in accordance with Lloyd's method and do not exceed a predetermined maximum size. In the transitional regions between the central zone 12 and the edge zones 13 and 14, the size of the holes 16 varies in accordance with equation (K). On one side of the central zone 12 there are two more zones 13' and 13" in which the holes 16 are larger than in zone 13 but do not grow in accordance with equation K. In 13' they grow less strongly, and in 13" their size is limited to a maximum value.

What is claimed is:

1. A shaving foil for an electric shaving apparatus, the foil comprising a perforated region comprising a surface defining a plurality of openings, each opening separated from adjacent openings by a substantially uniform distance, the perforated region comprising:

(a) a first edge zone;

(b) a second edge zone; and (c) a central zone arranged in a first direction between the first edge zone and the second edge zone, wherein the central zone comprises multiple openings along the first direction and along a second direction substantially perpendicular to the first direction; wherein the openings in the central zone have an average size smaller than the average size of the openings in the first edge zone and the second edge zone; wherein the perforated region comprises a curvature which has its zenith in the central zone; and wherein a floating mean value of a size of the openings in the central zone has a minimum value outside the zenith.

* * * * *